US007412995B2

(12) United States Patent
Arcese

(10) Patent No.: US 7,412,995 B2
(45) Date of Patent: Aug. 19, 2008

(54) TWO IN ONE HANDBAG

(76) Inventor: Danielle Arcese, 16 Bonmar Rd., Pelham Manor, NY (US) 10803

( * ) Notice: Subject to any disclaimer, the term of this patent is extended or adjusted under 35 U.S.C. 154(b) by 10 days.

(21) Appl. No.: 11/594,686

(22) Filed: Nov. 8, 2006

(65) Prior Publication Data

US 2008/0105508 A1 May 8, 2008

(51) Int. Cl.
*A45C 1/02* (2006.01)
*A45C 13/08* (2006.01)
*A45C 13/30* (2006.01)

(52) U.S. Cl. ..... 150/103; 150/118; 150/120; 150/127; 383/907

(58) Field of Classification Search ..... 150/100, 150/101, 103, 112, 120, 124, 118, 127; 190/20; 383/907; D3/232, 324
See application file for complete search history.

(56) References Cited

U.S. PATENT DOCUMENTS

| | | | | | |
|---|---|---|---|---|---|
| 615,790 | A | * | 12/1898 | Bpdwell | 206/748 |
| 739,754 | A | * | 9/1903 | Lovece | 150/133 |
| 886,540 | A | * | 5/1908 | Reid | 150/101 |
| 1,223,920 | A | * | 4/1917 | Wolf | 150/103 |
| 1,528,726 | A | * | 3/1925 | Max | 150/103 |
| 1,597,339 | A | * | 8/1926 | Berkowitz | 150/103 |
| 2,086,326 | A | * | 7/1937 | Goldberg | 2/66 |
| 2,245,875 | A | | 6/1941 | Rutherford | |
| 2,310,711 | A | | 2/1943 | Savage | |
| 2,493,182 | A | * | 1/1950 | Beder | 190/109 |
| 2,493,506 | A | * | 1/1950 | Schwartzbard | 150/103 |
| 2,508,669 | A | * | 5/1950 | Glover | 150/127 |
| 2,643,695 | A | * | 6/1953 | Smith | 150/136 |
| 2,809,467 | A | | 10/1957 | Pierre et al. | |
| 3,108,627 | A | * | 10/1963 | Tatelman | 150/103 |
| 3,530,614 | A | | 9/1970 | Strongin | |
| 3,770,034 | A | | 11/1973 | Eastman | |
| D235,080 | S | | 5/1975 | Verona | |
| 4,095,366 | A | | 6/1978 | Buck et al. | |
| 4,183,166 | A | | 1/1980 | Borner | |
| 4,657,248 | A | | 4/1987 | Benaim | |
| 4,738,558 | A | | 4/1988 | Hiromori | |
| D485,680 | S | * | 1/2004 | Hasenfrantz | D3/265 |

OTHER PUBLICATIONS

Alibaba.com; Gold Supplier—Shenzhen Shiao Electronics Co. Ltd, Magic Box Calculator With Metal Pen, http://shiyao.en.alibaba.com/product/50019066/50099348/calculators/magicbox.calcul . . . , 2 pages. printed from the Internet on Jul. 10, 2006.

* cited by examiner

*Primary Examiner*—Sue A Weaver
(74) *Attorney, Agent, or Firm*—Steven Horowitz

(57) ABSTRACT

A two-in-one handbag has different color patterns in two different closed positions. The handbag's two connected halves have inner rectangular facades and have outer arcuate façades having multiple horizontal segment, the first and second halves each having a substantially D-shaped cross-section. Flaps alternately cover the contiguous horizontal segments have outer sides of a first color and undersides of a second color so that a different color pattern emerges in the first closed position as compared to the second closed position. After the handbag is opened normally into two halves, it can continue to be opened when the halves continue to be rotated away from each to reach the second closed position by rotating the first outer arcuate façade along an entire surface of the second outer arcuate façade or vice versa. Each half's compartment is covered by a zippered cover to store objects. Reinforcing closure devices include magnets, snaps, Velcro.

12 Claims, 7 Drawing Sheets

TWO IN ONE HANDBAG

FIELD OF THE INVENTION

The field of this invention is handbags, and more particularly, two in one handbags.

BACKGROUND OF THE INVENTION AND DISCUSSION OF THE PRIOR ART

Women like to carry handbags that are stylish for going out and carrying items. The color of the handbag is chosen to match their attire. These handbags are expensive. Each time the woman wants a handbag that matches a different-colored dress she must employ a different-colored handbag. It would be useful to have a single handbag that can be rearranged or re-configured to display a different color pattern in different positions.

A known product is a small pen/calculator case with flaps covering one-third segments of the length of the case. After opening the spine continues to fold back on itself and the flaps flip over to reveal their other side. The flaps have the same color on each side. But the structure allows the case to assume two different closed positions.

SUMMARY OF THE PRESENT INVENTION

The present invention is a two in one handbag that allows a woman to buy one handbag and yet two different colored handbags each of which matches a different set of attire. Moreover, by switching the appearance of the handbag without leaving her location she can create the impression that she switched handbag, a useful impression in certain social situations. Furthermore, if the woman desires to reveal the manner in which the handbag switches from one outer appearance to the other outer appearance, she would be demonstrating an optical illusion that can achieve a charm and appeal not afforded by other handbags.

The handbag opens in a surprising way when what seemed to be a spine connecting the two halves of the handbag manages to separate and open further by rotation of one of the halves in relation to the other. This happens because the two halves are not really connected to one another other than by flaps that have color patterns. The flaps are sufficiently thin to appear to be colored surfaces of the horizontal segments rather than separate flaps and the two halves are connected by the flaps. The flaps have one color on one side and the other color on the other side. For example one side of a flap may be gold on one side and an adjacent segment of the outer arcuate facade of that half is not covered by a flap but is of a neutral color and the next adjacent segment is covered by a flap that is gold on one side. If the other side of the two flaps are silver, then the handbag will look gold (and neutral) in one closed position and silver (and neutral) in a second closed position. Thus a lady owning the handbag would have a gold handbag to be worn with dresses matching gold and which can be turned into a silver handbag to be worn with dresses matching silver.

Due to the fact that handbags carry valuables, the handbag has a closure mechanism separate from the fact that the handbag is urged closed by its structure.

IMPORTANT OBJECTS AND ADVANTAGES

The following important objects and advantages may appear in certain embodiments of the present invention:

(1) to provide a two-in-one handbag;

(2) to provide a handbag that can be carried by adults, and particularly by women;

(3) to provide a handbag that has a compartment for storing personal effects in each half of the handbag;

(4) to provide a handbag that displays a first particular color pattern when desired and that can display a second and different color pattern when also desired;

(5) to provide a handbag that can easily be moved from one closed position to the second closed position in a few seconds by the holder;

(6) to provide a handbag that moves from one closed position to a second closed position by either rotating the first outer arcuate facade along an entire surface of the second outer arcuate facade or by rotating the second outer arcuate facade along an entire surface of the first outer arcuate facade;

(7) to provide a handbag that whose two halves are unconnected to each but are held to each other by a series of flaps that cover alternately contiguous horizontal segments of the outer arcuate facades of each half (8) to provide such a handbag wherein the flaps are thin enough to not appear to be flaps but rather to appear to be colored surfaces of the horizontal segments of the outer arcuate facades;

(9) to provide a handbag wherein its two halves appear to be held together by a normal spine;

(10) to provide a handbag that is held securely closed not only by a natural urging of the two halves together but also by a separate additional closure structure;

(11) to provide such a handbag wherein one means for keeping it closed is the urging of the halves together by the flaps;

(12) to provide such a handbag that can be held closed more securely by either magnets, Velcro, snaps or other closure mechanism;

(13) to provide a handbag that optionally has a handle;

(14) to provide such a handbag wherein the handle removably attaches to loops extending from the first or second inner rectangular facade;

(15) to provide such a handbag wherein the handle may in alternative embodiments extend from a top or bottom surface;

(16) to provide a handbag whose halves have a substantially D-shaped cross-section;

(17) to provide a handbag that has a substantially elliptical cross-section when closed;

(18) to provide a handbag wherein a series of flaps has an alternate color sequence;

(19) to provide a handbag where the flaps have one color on the outer side and a second color on the underside;

(20) to provide a handbag wherein the compartment for personal effects has a longitudinal zipper for accessing and securing the effects;

(21) to provide a handbag wherein each compartment is a hollow concave space that is covered preferably by a non-rigid material;

(22) to provide a handbag wherein in each half the inner rectangular facade has a rectangular perimeter;

(23) to provide a handbag in which either half of the handbag can rotate 720 degrees in one direction with respect to the other half of the handbag;

(24) to provide a handbag that can move from a first closed position to a second closed position by rotating one half of the handbag along the outer surface of the other half of the handbag;

(25) to provide a two-in-one handbag wherein a woman can go to the restroom and come back with what appears to be a different handbag;

(26) to provide a handbag that has all the practicalities of a handbag but also has the charm of an optical illusion and/or hidden compartment;

(27) to provide a handbag that saves the cost of purchasing two different handbags to match two differently colored dresses or two different colored coats, shoes, scarves, hats or other outerwear;

(28) to provide a handbag that is more stylish than most handbags;

(29) to provide a handbag that can look gold and neutral sometimes and silver and neutral other times; and

(30) to provide a handbag that opens in a surprising way.

DETAILED DESCRIPTION OF THE PREFERRED EMBODIMENT

Figure 1:
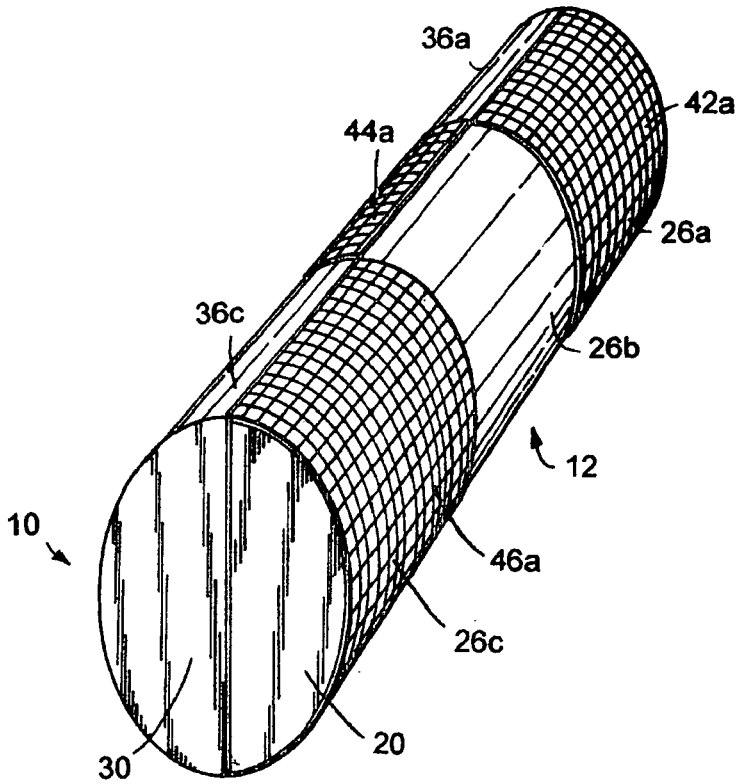
FIG. 1 is a perspective view of the handbag of the present invention in a first closed position having a silver and neutral color pattern;.
Figure 2:
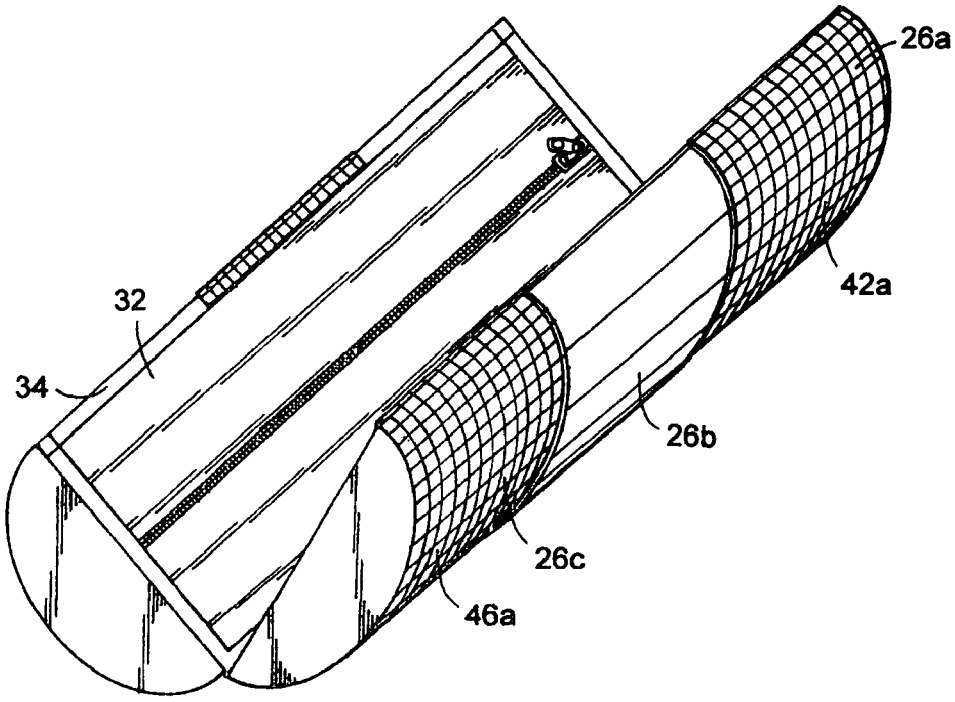
FIG. 2 is a perspective of the handbag of FIG. 1 partially opened wherein one of the halves has rotated approximately 90 degrees from where it was in FIG. 1.
Figure 3:
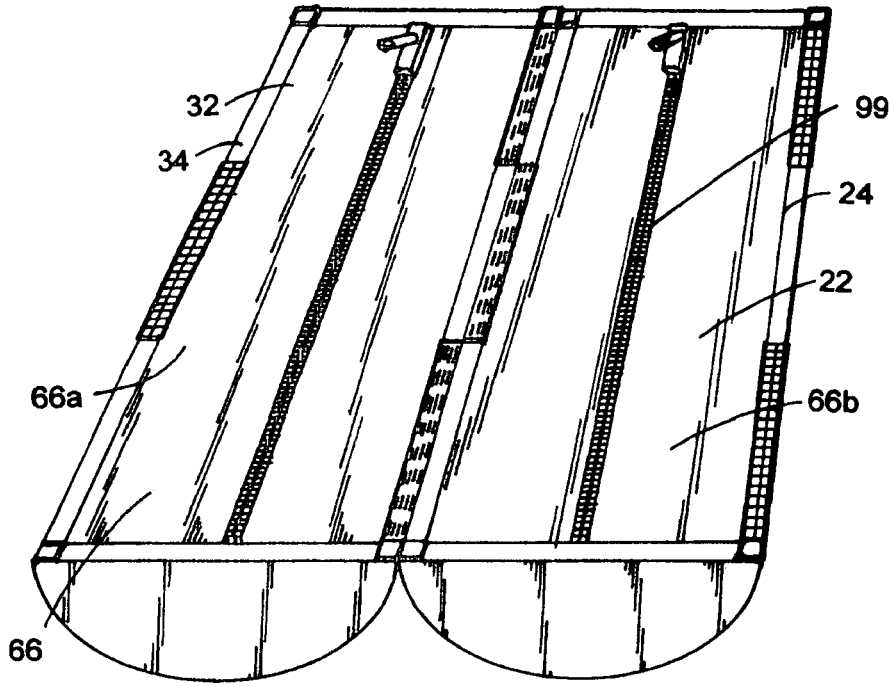
FIG. 3 is a perspective of the handbag of FIG. 1 fully opened to the normal open position and one of the halves has rotated approximately 180 degrees from where it was in FIG. 1.
Figure 4:
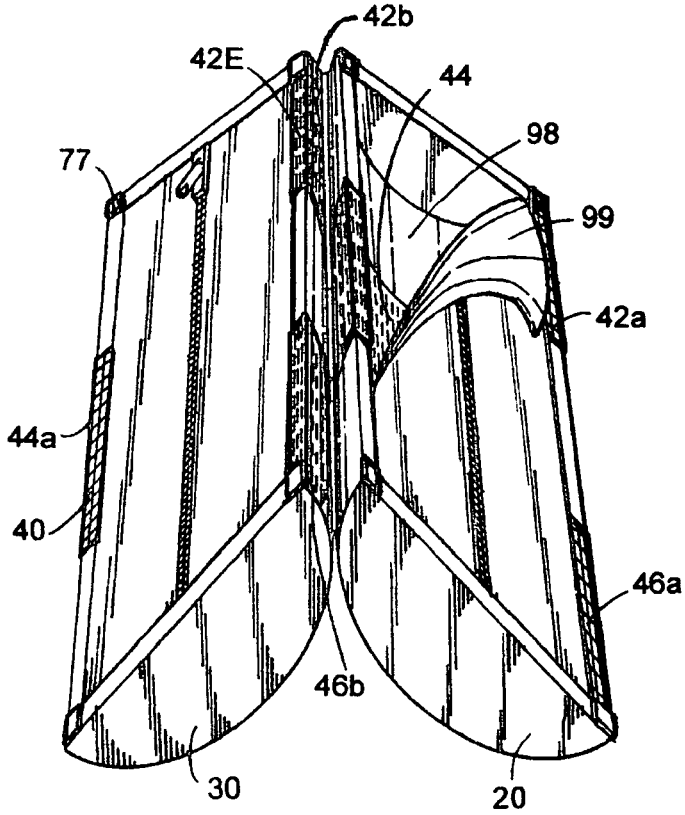
FIG. 4 is a perspective view of the handbag of FIG. 1 further opened so that one of the halves has rotated to be approximately 270 degrees from where it was in FIG. 1 and with a main portion of the second inner rectangular facade peeled away.
Figure 5:
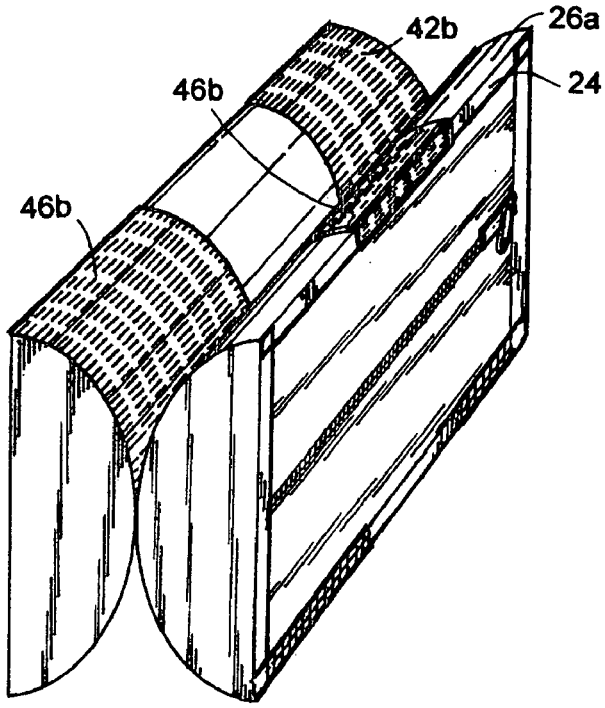
FIG. 5 is a perspective view of the handbag of FIG. 1 further opened so that one of the halves has rotated approximately 360 degrees from where it was in FIG. 1;.
Figure 6:
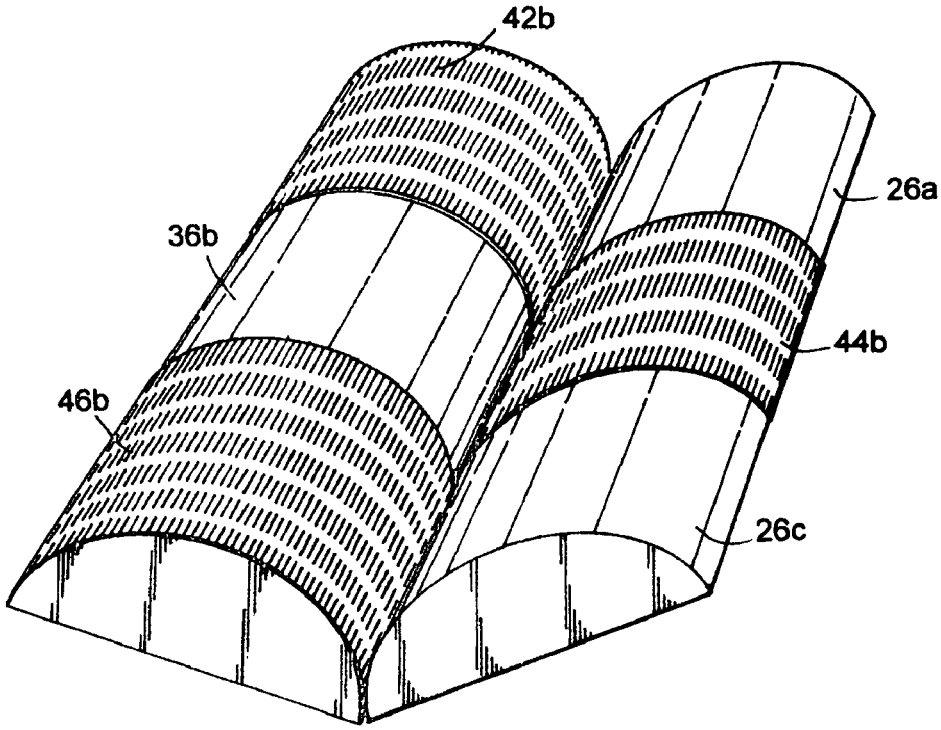
FIG. 6 is a perspective view of the handbag of FIG. 1 further opened so that one of the halves has rotated approximately 495 degrees from where it was in FIG. 1.
Figure 7:
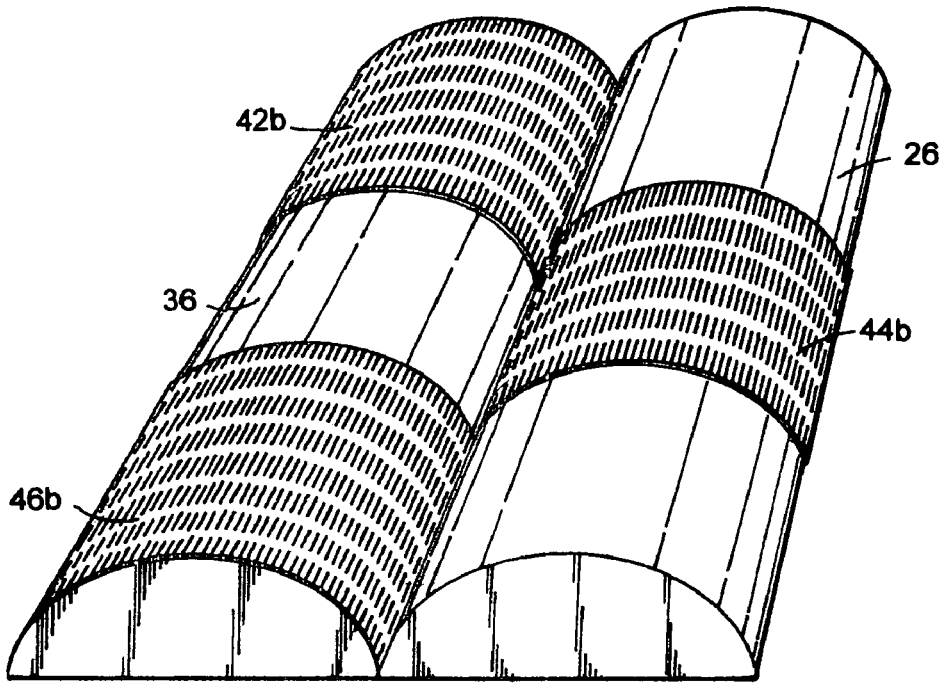
FIG. 7 is a perspective view of the handbag of FIG. 1 wherein one of the halves has rotated approximately 540 degrees from where it was in FIG. 1.

The apparatus of the present invention will now be illustrated by reference to the accompanying drawings. The handbag of the present invention has been assigned reference numeral 10 Other elements have been assigned the reference numerals referred to below.

Handbag 10 is a two-in-one handbag that can be presented in two different color patterns by simply opening the handbag 10 from one position to the other. The basis for the illusion is that the two halves of the handbag are not connected to one another other than by thin flaps that have one color on one side, i.e. the outer side of the flap, and a second color on the inner side or underside of the flap.

As seen from FIGS. 1-12, handbag 10 has a body 12 that has an elliptical cross-section when closed and that comprises a first half 20 and a second half 30. Each half has a substantially D-shaped cross-section although the ends of the ends of the arc of the "D" may be pointier than would be the case in a regular half of an ellipse.

Figure 8:
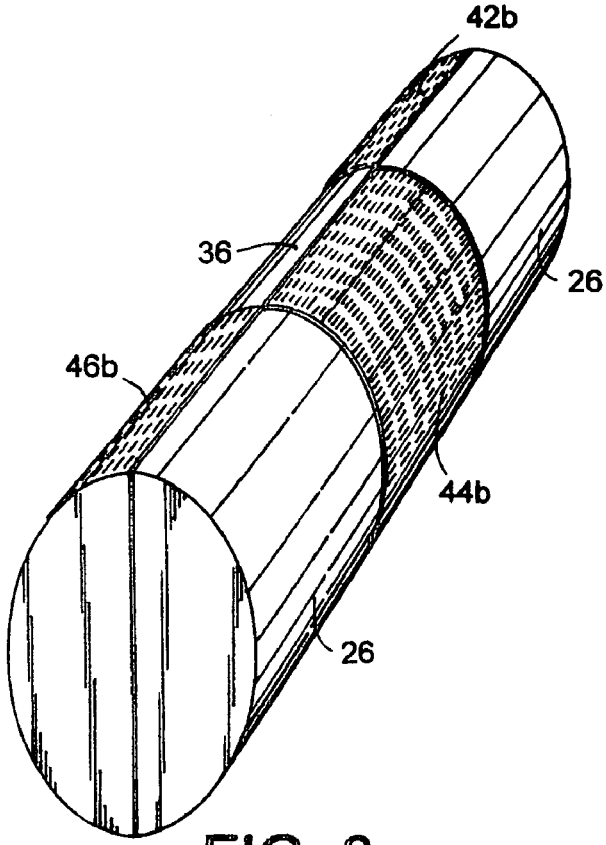
FIG. 8 is a perspective view of the handbag of FIG. 1 in the second closed position wherein one of the halves has rotated approximately 720 degrees from where it was in FIG. 1.

Handbag 10 has a first color pattern in a first closed position as seen in FIG. 1 and a second color pattern in a second closed position, as seen in FIG. 8. For example, FIG. 1 shows a silver and neutral color pattern and FIG. 8 shows a gold and neutral color pattern.

First half 20 has a first inner rectangular facade 22 having a first rectangular perimeter 24 and a first outer arcuate facade 26. First outer arcuate facade 26 has a series of adjacent segments that divide it. In one preferred embodiment there are three such segments. In other preferred embodiments, there may be other amounts of such segments in the first half and in the second half. For example, there could be two, four five or six horizontal segments, or even more.

First inner rectangular facade 22 (as well as second inner rectangular facade 32 described below) may comprise, besides its rigid rectangular perimeter 24 or 34, a cover 66*a*, 66*b* or cover material, typically although not necessarily flexible, that covers the compartment defined by the inside walls first half 20. This compartment can be thought of as a hollow concave area and may be used to store personal effects or other objects. The first and second inner rectangular facades 22, 32 include their respective rectangular perimeters but in certain embodiments they may also be full rigid rectangular planes that include and extend from said perimeters. Alternatively, as noted, facades 22, 32 may be comprised of a rigid perimeter 24, 34 plus a less rigid or malleable cover 66. Covers 66*a*, 66*b* may be, include or form part of a removable insert 99, as described more fully below.

In a preferred embodiment, the first inner rectangular facade 22 has a longitudinal zipper or other mechanism for opening said compartment. In a second preferred embodiment as shown in the drawings both inner rectangular facades 22, 32 are covered by a material that has a zipper or other mechanism for opening and closing or providing access to the space below the facades 22, 32.

In a preferred embodiments, regardless of the number of horizontal segments, the color pattern should alternate between the color of the flaps covering each horizontal segment, as further described below, and a neutral color of the surface of the facade 26 uncovered by a flap. However, it is also contemplated by the present invention that in various alternative embodiments, other colors patterns can be envisioned. For example, the first two horizontal segments can have the same color, for example gold flaps, and the third and fourth horizontal segments can have no flaps and reveal a neutral color or whatever other color the surface of the outer arcuate facade is. This applies to both halves of the device 10. The number of color patterns is only limited by what the mind can imagine. The idea, in a preferred embodiment, is to end up with a handbag looking different in a first closed position than in a second closed position.

In this patent disclosure, it should be noted that the terms "color" and "color pattern" are taken broadly to mean anything that produces a particular appearance. Two color patterns are different if they produce different appearances. Thus, for example a different texture can produce a different appearance and even though the material is theoretically of the same color.

In the preferred embodiment shown in FIGS. 1-12, there are three segments dividing the outer arcuate facade 26 (and three dividing the second outer arcuate facade). These include first horizontal segment 26*a*, a second horizontal segment 26*b* and a third horizontal segment 26*c*.

Similarly, the second half 30 has a second inner rectangular facade 32 having a second rectangular perimeter 34 and a second outer arcuate facade 36. Second outer arcuate facade 36 has a series of adjacent segments that divide it. In one preferred embodiment, such as shown in the drawings, there are three such segments. In other embodiments there may be two, four or more. The number of segments of first outer arcuate facade 26 and the number of segments of second outer arcuate facade 36 should be equal in the preferred embodiment.

As in the first half, in the second half also there are, in the preferred embodiment shown in FIGS. 1-12, three segments dividing second outer arcuate facade 36—a first horizontal segment 36*a*, a second horizontal segment 36*b* and a third horizontal segment 36*c*.

It appears to an observer of handbag 10 who has not examined handbag 10 closely that first half 20 and second half 30 are connected to another in the normal manner, which is to say by some kind of spine, in light of the fact that it can be seen by the observer that the two halves 20, 30 rotate with respect to one another like something that opens along a spine, such as a book or an eyeglasses case. However, the two halves 20, 30 are actually disconnected from one another except for a series of flaps 40. The series of flaps 40 hold the first half 20 and the second half 30 together.

The number of flaps in the series of flaps 40 is equal to the number of segments of the outer arcuate facades 26, 36. In the preferred embodiment shown in FIGS. 1-12, there are three flaps including first flap 42 whose outer side 42*a* is of a first color and whose underside 42*b* is of a second color, a second flap 44 whose outer side 44*a* is of the first color and whose underside 44*b* is of the second color, and a third flap 46 whose outer side 46*a* is of the first color and whose underside 46*b* is of the second color.

It should be noted that in the first closed position shown in FIG. 1, the first flap 42 and third flap 46 cover the first horizontal segment 26*a* and third horizontal segment 26*c* of the first outer arcuate facade 26 respectively whereas the second flap 44 covers the second horizontal segment 36*b* of the second outer arcuate facade 36. It is further noted that in the second closed position shown in FIG. 8, the first flap 42 and third flap 46 covering the first horizontal segment 36*a* and third horizontal segment 36*c* of the second outer arcuate facade 36 whereas the second flap 44 covers the second horizontal segment 26*b* of the first outer arcuate facade 26.

The present invention contemplates that each of the flaps 42, 44, 46 are sufficiently thin so that they appear to be colored surfaces of the horizontal segments rather than flaps. This adds to the illusion and charm of handbag 10. Typically, in order to accomplish the purposes of the present invention the flaps of the present invention should be malleable and thin. Any material that accomplishes the function and purposes of the flaps is acceptable.

In each case, each flap that covers a particular horizontal segment of first outer arcuate facade 26 or of second outer arcuate facade 36 extends into and is attached to some portion of the other half of handbag 10, and preferably a portion that is contiguous to the horizontal segment that the flap covers. In particular, the flap extends into and is attached securely to a portion of inner rectangular facade of the other half of handbag 10 by any well known attachment mechanism. The manner in which the flap attaches to the other half of the handbag and the degree of extension into the other half of the handbag are not essential.

For example, first flap 42 covers the outer arcuate facade 26 of the first half 20 and then has an extension 42E that extends into the second half 30, typically into second inner rectangular facade 32. Extension 42E (and the other extensions of the flaps) may be attached to and/or tucked under cover 66 of facade 22 or 32 or may be attached to or tucked under removable insert 99 sitting on the respective inner rectangular facade (22 or 32), which insert 99 may have a bottom that conforms to the surface of the concave compartment formed on the inside of half 20, 30 as a result of the curvature of outer arcuate facade 26, 36. As seen from the drawings, at a minimum, extension 42E (and other extensions of flaps 42, 44, 46 extend into a portion of the rectangular perimeter 23, 33 of inner rectangular facade 22 or 32. As seen from FIG. 4, flap 44 extends from second half 30 into first half 20 under insert 99 and is attached and secured by any well known means to the inside 98 of first half 20. Thus flap 44 extends beyond the rectangular perimeter 23 of inner rectangular facade 22. The flaps may be secured by any suitable means including being tucked under an insert, by adhesive, friction fit, snap, hook, Velcro®, clamp, or anything else.

Handbag 10 is urged closed on its own in both the first and second closed position but has a further closure mechanism, in a preferred embodiment, for ensuring that the handbag remains closed in both positions.

One such closure structure is magnets 77 positioned at the corners of inner rectangular facades 22, 32. Obviously the magnets which may be attached to these corners by adhesive or any suitable means, including being embedded under the top surface thereof, are matched in polarity to effectuate the closure. Thus, the closure structure includes at least a first pair of magnets 77 located at a first corner of the first rectangular perimeter and second pair of magnets located at a second corner of the second rectangular perimeter, the first pair of magnets having an attraction toward the second pair of magnets.

Figure 9:
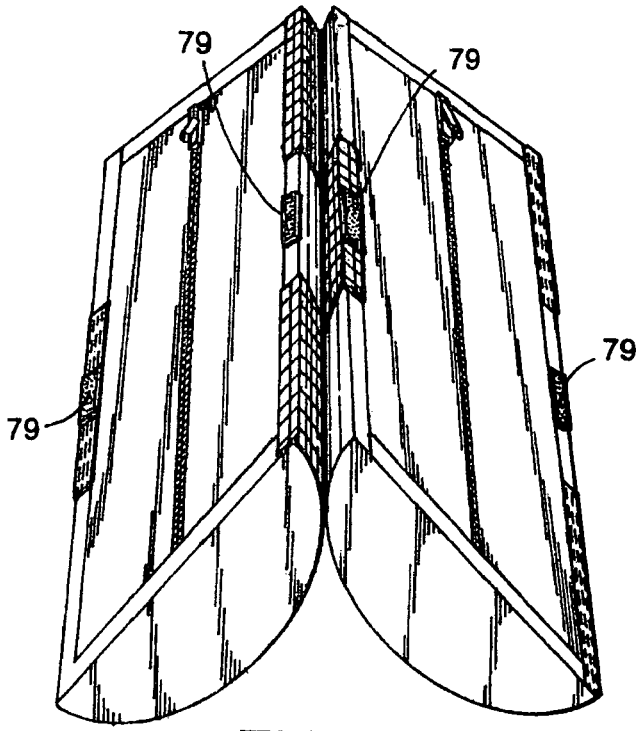
FIG. 9 shows a perspective view similar to FIG. 4 of the handbag of the present invention with an extra closure mechanism.
Figure 10:
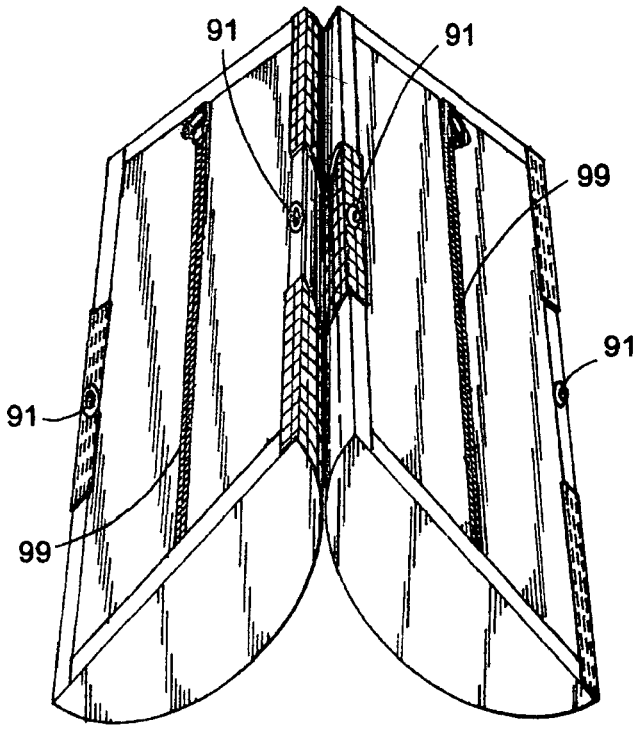
FIG. 10 shows a perspective view similar to FIG. 4 of the handbag of the present invention with an alternative embodiment of the extra closure mechanism.

Alternatively, as shown in FIGS. 9 and 10, or in addition, the closure structures can include a male fastener extending from the first half and a female fastener structure extending from the second half. Examples of such fasteners can include Velcro® 79 (see FIG. 9) or snaps 91 (see FIG. 10). In either case, the closure structure is capable of keeping handbag 10 securely closed in the first closed position as well as in the second closed position. It should be clearly understood that other closure mechanisms can be thought of by practitioners of the art consistent with the present invention.

As seen from FIGS. 1-11, and in particular FIGS. 1-8, handbag 10 is capable of moving between the first closed position and the second closed position by either rotating the first outer arcuate facade along an entire surface of the second outer arcuate facade or by rotating the second outer arcuate facade along an entire surface of the first outer arcuate facade.

A "D-shaped" cross-section is understood to be formed by a line fragment whose two ends are connected by an arc, whether the arc is semi-elliptical, semi-ellipsoidal, semi-circular or semi-ovular even if the ends of the arc are pointier than would be the case in a regular semi-ellipse.

Figure 11:
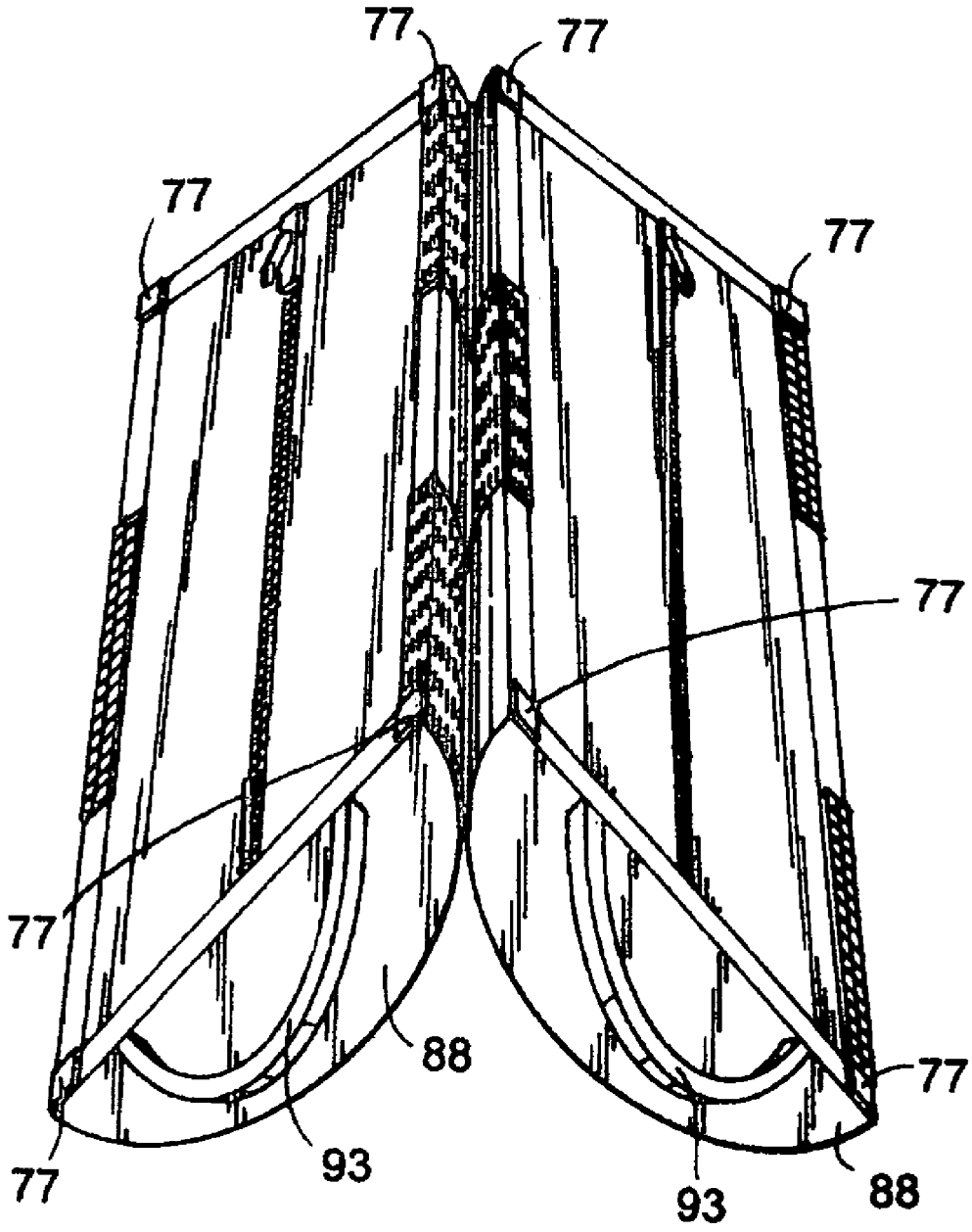
FIG. 11 shows a perspective view similar to FIG. 4 with a handle.

In a preferred embodiment, handbag 10 has a handle. In one embodiment of such a handle shown in FIG. 11, handbag 10 has handle 93 extending from top surface 87 or from bottom surface 88 of handbag 10. In that case, half of handle 93 may protrude from the top surface (or the bottom surface) of a particular half 20, 30 and a second half of the handle may protrude from the same top (or bottom) surface of the adjacent half 20, 30, as best seen in FIG. 11.

Figure 12:
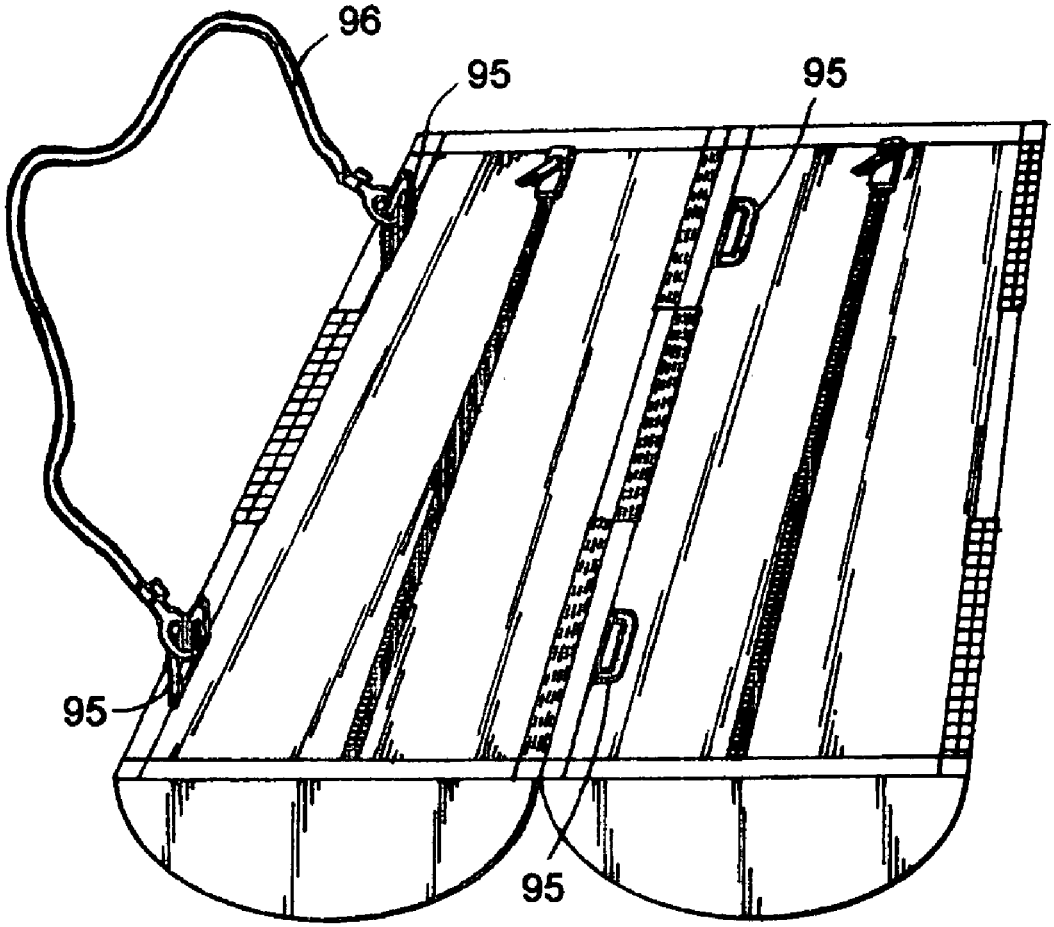
FIG. 12 shows a perspective view as in FIG. 3 but with an alternative detachable handle and loops.

More preferably, FIG. 12 shows a different configuration for the handle. In this case, handbag 10 has two loops 95 in the first half 20 and two loops 95 in the second half 30. Loops 95 are very thin metal such as aluminum so that when not in use they can be bent over as is the case with the loops 95 in second half 30 whereas the loops 95 can be straightened up when handle 96 needs to be attached to them. Using the handle 96 shown in FIG. 12, handbag 10 can be carried more normally than with the handle shown in FIG. 11. It is noted that loops 95 do not interfere with or obstruct the rotation of the halves 20, 30 of handbag 10 because one pair of loops are wedged between first rectangular perimeter 24 and cover 66*a* of facade 22 (and not at the very edge of facade 22) and the two other loops are only wedged between second rectangular perimeter 34 and cover 66*b* of facade 32 (and not at the very edge of facade 32). In one preferred embodiment, loops 95 sit of a tiny hinge (not shown) that allows it to rotate repeatedly without breaking. Thus the term loop structure can be understood to include loops with a hinge and loops without a hinge.

It should be understood that the handbag described herein can be modified and still be within the teachings of the present invention. The essential concept of the present invention is a handbag whose halves are connected by alternating flaps and that can display a first color pattern in a first closed position and a second color pattern in a second closed position. It is not essential if the cross-section is elliptical or circular. Nor is the actual color pattern essential. The number of horizontal segments and the number of flaps can also be varied.

It is to be understood that while the apparatus of this invention have been described and illustrated in detail, the above-described embodiments are simply illustrative of the principles of the invention. It is to be understood also that various other modifications and changes may be devised by those skilled in the art which will embody the principles of the invention and fall within the spirit and scope thereof. It is not desired to limit the invention to the exact construction and operation shown and described. The spirit and scope of this invention are limited only by the spirit and scope of the following claims.

What is claimed is:

1. A handbag having a first color pattern in a first closed position and a second color pattern in a second closed position, comprising:

a body having a first half and a second half, a cross-section of the body when the body is closed being elliptical, the first half having a first inner rectangular facade having a first rectangular perimeter and a first outer arcuate facade, the first outer arcuate facade having a first horizontal segment, a second horizontal segment and a third horizontal segment, the second half having a second inner rectangular facade having a second rectangular perimeter and a second outer arcuate facade, the second outer arcuate facade having a first horizontal segment, a second horizontal segment and a third horizontal segment, a series of flaps holding the first and second halves together, the series of flaps including a first flap whose outer side is of a first color and whose underside is of a second color, a second flap whose outer side is of the first color and whose underside is of the second color, a third flap whose outer side is of the first color and whose underside is of the second color, in the first closed position, the first and third flaps covering the first and third horizontal segments of the first outer arcuate facade and extending into and attaching to a contiguous portion of the second inner rectangular facade and the second flap covering the second horizontal segment of the second outer arcuate facade and extending into and attaching to a contiguous portion of the first inner rectangular facade, in the second closed position, the first and third flaps covering the first and third horizontal segments of the second outer arcuate facade and extending into and attaching to a contiguous portion of the first inner rectangular facade and the second flap covering the second horizontal segment of the first outer arcuate facade and extending into and attaching to a contiguous portion of the second inner rectangular facade, the handbag capable of moving between the first closed position and the second closed position by either rotating the first outer arcuate facade along an entire surface of the second outer arcuate facade or by rotating the second outer arcuate facade along an entire surface of the first outer arcuate facade.

2. The handbag of claim 1, including a closure structure for securely keeping the handbag closed in the first closed position and in the second closed position.

3. The handbag of claim 2, wherein the closure structure comprises a first pair of magnets located at a corner of a first rectangular perimeter of the first inner rectangular facade and second pair of magnets located at a second corner of a second rectangular perimeter of the second inner rectangular facade, the first pair of magnets having an attraction toward the second pair of magnets.

4. The handbag of claim 2, wherein the closure structure includes a male fastener extending from the first half and a female fastener structure extending from the second half.

5. The handbag of claim 1, wherein the first inner rectangular facade includes a cover that covers a compartment that stores objects.

6. The handbag of claim 5, wherein said cover has a longitudinal zipper for opening said compartment.

7. The handbag of claim 1, wherein the first inner rectangular facade surrounds a hollow concave area.

8. The handbag of claim 1, wherein the flaps are sufficiently thin to appear to be colored surfaces of the horizontal segments rather than separate flaps.

9. The handbag of claim 1, wherein the first and second halves each have substantially D-shaped cross-sections.

10. The handbag of claim 1, including a handle.

11. The handbag of claim 10, wherein the handle extends from a top or bottom surface of the handbag.

12. The handbag of claim 10, wherein the handle is detachable and can be affixed either to a first pair of loops extending from the first inner rectangular facade or to a second pair of loops extending from the second inner rectangular facade.

* * * * *